US007537192B2

(12) United States Patent
Al-Haleem et al.

(10) Patent No.: US 7,537,192 B2
(45) Date of Patent: May 26, 2009

(54) LIGHTWEIGHT COMBINED FOLDER AND VARIABLE POSITION DISPLAY/BOOK STAND

(76) Inventors: Abdel Khalid Al-Haleem, 7258 Oxfordshire Ave., Jacksonville, FL (US) 32219; Derrick Wayne Roberts, 3060 Brombley Dr., Conyers, GA (US) 30013

( * ) Notice: Subject to any disclaimer, the term of this patent is extended or adjusted under 35 U.S.C. 154(b) by 0 days.

(21) Appl. No.: 11/339,880

(22) Filed: Jan. 26, 2006

(65) Prior Publication Data

US 2006/0249646 A1 Nov. 9, 2006

(51) Int. Cl.
*A47B 97/04* (2006.01)
*A47B 23/00* (2006.01)
*A47G 1/24* (2006.01)

(52) U.S. Cl. ..... 248/459; 248/455; 248/454; 248/460; 281/33; 281/45

(58) Field of Classification Search ..... 248/441.1, 248/459, 445, 446, 450, 454, 460, 461, 444, 248/451, 452, 453; 108/43; 281/33, 45
See application file for complete search history.

(56) References Cited

U.S. PATENT DOCUMENTS 289,652 A * 12/1883 Haynes ..... 248/451
2,165,255 A * 7/1939 Hamilton ..... 248/455
2,236,591 A * 4/1941 Barrett ..... 281/33
2,251,780 A * 8/1941 Canning ..... 281/33
2,373,617 A * 4/1945 Tiryakian ..... 248/453
2,490,356 A * 12/1949 Hummel ..... 248/463
2,550,279 A * 4/1951 Mamer ..... 248/453
2,726,835 A * 12/1955 Hummel ..... 248/459
3,125,356 A * 3/1964 Cline ..... 281/33
3,128,108 A * 4/1964 Finch ..... 281/33
3,195,850 A * 7/1965 Steiner ..... 248/454
3,367,679 A * 2/1968 Slanhoff ..... 281/33
3,544,134 A * 12/1970 Sibley ..... 281/33
3,785,605 A * 1/1974 Parekh ..... 248/455
3,981,522 A * 9/1976 Bloom ..... 281/34
4,240,761 A * 12/1980 Jacobson ..... 402/76
4,607,817 A * 8/1986 Aquino ..... 248/459
4,709,895 A * 12/1987 Mardak ..... 248/460
4,817,905 A * 4/1989 Rondone ..... 248/459
4,886,231 A * 12/1989 Doerksen ..... 248/455
4,981,386 A * 1/1991 Beleckis ..... 402/73
4,991,812 A * 2/1991 MacEwan ..... 248/459
5,165,648 A * 11/1992 Quigley ..... 248/451
5,829,729 A * 11/1998 Welch et al. ..... 248/441.1
6,270,049 B1 * 8/2001 Olvey ..... 248/441.1
2005/0012016 A1 * 1/2005 Teuscher ..... 248/460

* cited by examiner

*Primary Examiner*—Kimberly T Wood
(74) *Attorney, Agent, or Firm*—Hugh B. Thompson

(57) ABSTRACT

A multi-purpose portfolio formed from a sheet of rigid card with transverse hinged lines dividing the card into a number of panels that may be completely folded into its closed or carrying position, partially unfolded to access pen, pad, and the likes, and fully erectable for use as a podium, book holder or display stand. The major front panel and major back panel are secured together at their upper edges by a hinge line, and each has a narrow panel hinged along its bottom edge. In its fully erect position, the major front panel is inclined to hold books. Each panel has a hinge line along its bottom edge that secures a narrow panel.

1 Claim, 9 Drawing Sheets

LIGHTWEIGHT COMBINED FOLDER AND VARIABLE POSITION DISPLAY/BOOK STAND

FIELD OF INVENTION

The present invention is related to oratorical document props and portfolios, or more simply put, bookstands and folders. More specifically, the invention is drawn to a portable document support, i.e., a bookstand, which can be repositioned into a document folder.

BACKGROUND OF INVENTION

There are many type document props and portfolios that offer different levels of flexibility or levels of convenience. These existing devices tend to be cumbersome, complex, or have a linear usage. None offer the convenience and flexibility disclosed in at least one embodiment of the claimed invention.

The book stand/folder of the present invention seeks to combine the utility of book stand with the storage and transportability of a folder, thus creating a device that can easily be reconfigured between desired uses. The prior art attempts to address such functionality in many ways. Past devices include bookstands that have pocket or pouches on either side of the stand to receive articles. Others do fold along middle portions with supports thereon. however, the prior art fails to provide folding supports with multiple sections that fold and align in reverse positions so as to convert between a open position in which the book stand has opposed sides for receipt thereon of opposed covers of a book, and a closed position in which rear supports of the book stand are closed in such a way as to allow a now reversed folded stand or display to be used as a folder or carrier of documents. The primary objective of the claimed invention is to provide a lightweight, flexible, convenient, and portable support document prop.

SUMMARY OF INVENTION

The invention can be summarized as a folder/book stand comprising a main right portion; a main left portion; the right and left portions each having an outer and inner face; the right portion and left portion pivotally attached to each other along longitudinal edges thereof; the right and left portions having respective lower support sections pivotally attached along bottom edges thereof; the inner faces having respective right and left rear support sections pivotally attached thereto; the right and left rear support sections each having lower portions pivotally attached along bottom edges thereof; a first attachment means affixed to one of the rear support sections; a second attachment means affixed to the inner face of one of the right and left portions; the first and second attachment means adjustably attachable to one another.

The folder/book stand of the present invention, offers a number of advantages to those requiring a book or document support mechanism. It is an effective document support tool for oral presentations, reading, or writing. This single unit device requires no assembly and is easily and conveniently transported for usage. The device provides a sturdy support base for books and documents of small to medium size and moderate weight. It can be quickly prepared for usage. It can just as quickly be collapsed for storage and/or transporting. This product offers a number of advantages to those requiring a book or document support mechanism. It is an effective document support tool for oral presentations, reading, or writing.

Some benefits to a preferred embodiment include:

1. A single unit requiring no assembly;
2. Easily and conveniently transported to affairs;
3. A sturdy support base for books and documents of small to medium size; and moderate weight;
4. Can be quickly arranged for usage;
5. Can be quickly prepared for transporting and/or storage;
6. Provides a convenient storage position.

DETAILED DESCRIPTION OF THE INVENTION

First Embodiment

Figure 1:
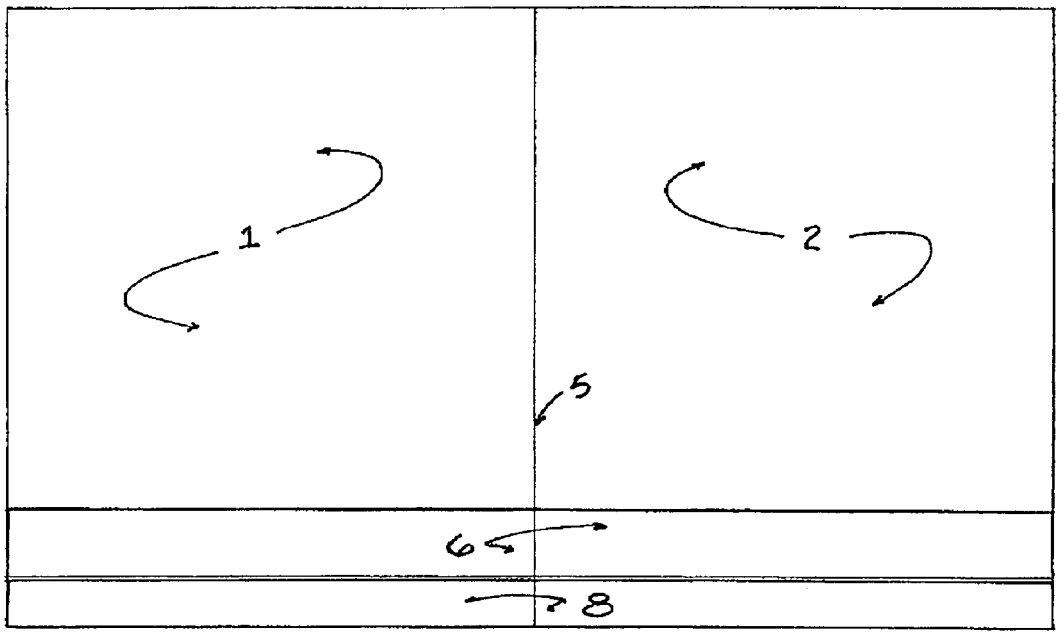
FIG. 1 is a 1st embodiment view of the inside cover in a fully open position.
Figure 2A:
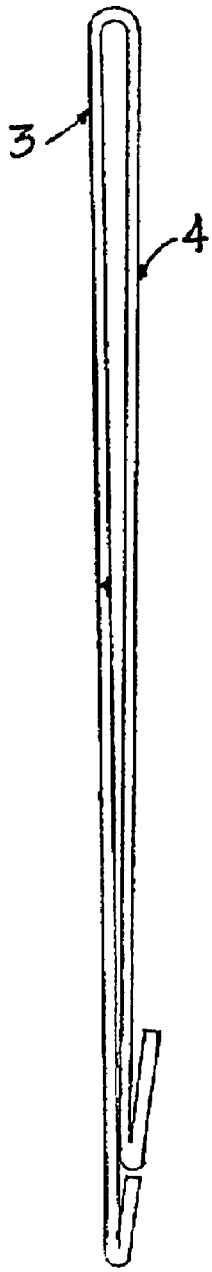
FIG. 2*a* is a 1st embodiment side view of the folder/stand in an open position.
Figure 2B:
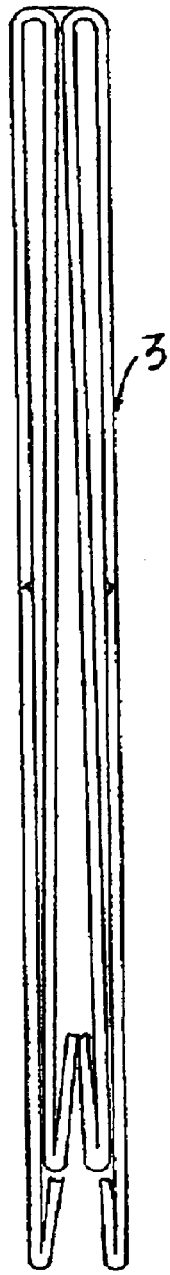
FIG. 2*b* is a 1st embodiment side view of the folder/stand in a closed position.

Referring to the figures, the invention is referred to as a book stand 4. FIG. 1 is a frontal unfolded view. This frontal view shows that it has a flat support surface that serves as a rest or podium for a book or documents. The flat support surface consists of two panels 1, 2, which are formed by scoring a sturdy cardboard like substance into halves along longitudinal edges thereof, or by affixing two panels into one by using a flexible member 5 that will allow the two sides to fold together. Flat surfaces 1 (left main portion) and 2 (right main portion), can also be formulated by using a cloth or other material to enclose a sturdy substance such as a cardboard or plastic. The seam of the cloth serves as the fastener for securing the two sides/flat surfaces 1 and 2 together. The surface areas can be embroidered with various decors. Each flat surface has two lower flaps 6 and 8 that are displayed in their folded ready for storage positions. These lower flaps 6 and 8 are also scored vertically in halves or by affixing two panels into one by using a flexible member that will allow the two sides to fold together. The first of the lower flaps 6 serves a support rest for a book or documents. A book or document support rest, i.e., flap 6, is attached to each of the flat surfaces 1 and 2, respectively. Each lower flap 8 in FIG. 2 is affixed to a respective lower rear panel 7 (right and left rear support sections) and used to adjust the slope of the book stand. When in the opened or unfolded position as seen in FIG. 2*a*, the lower flap 8 can be folded upward fastens to the lower rear panel 7. The lower rear panel 7 can be scored or affixed to rear face support surface 3 at relatively any horizontal location. The lower rear panel 7 can be adjusted to increase or decrease the slope of the book stand.

Figure 2C:
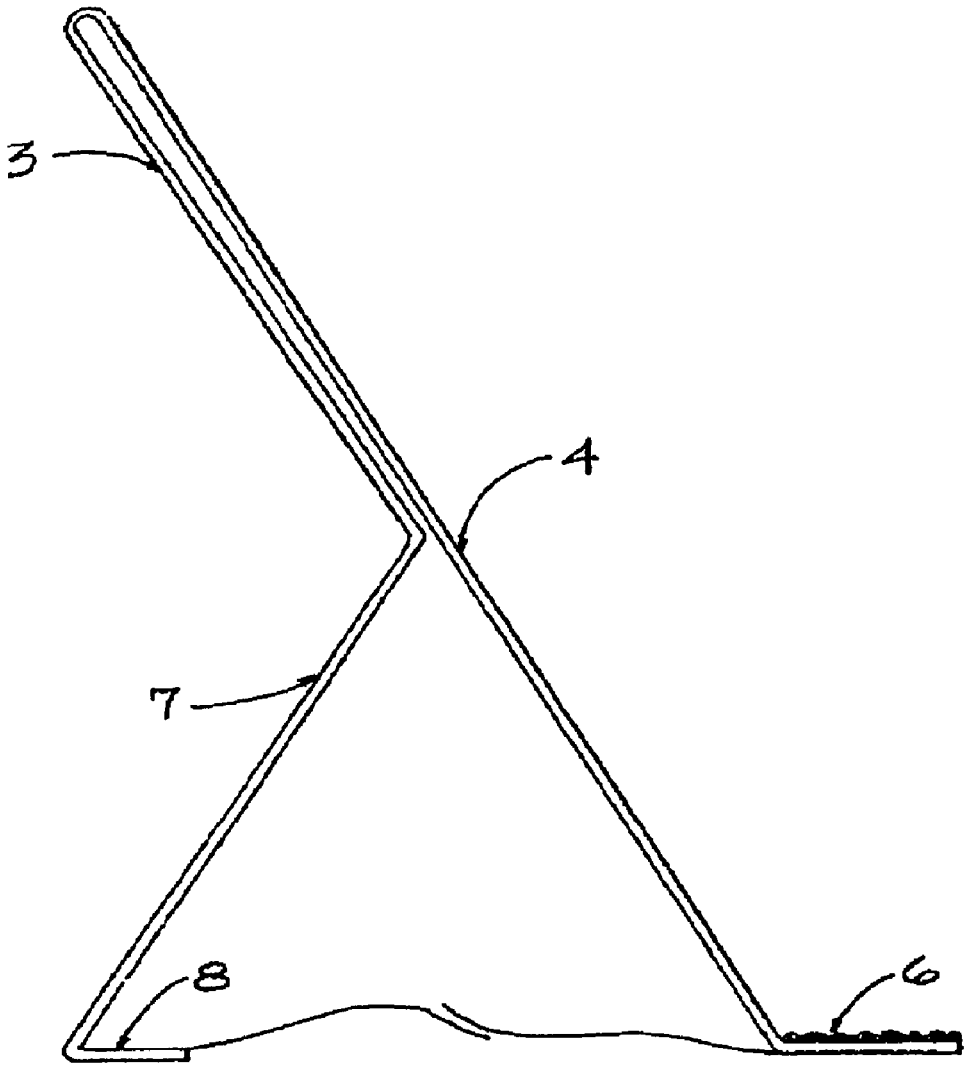
FIG. 2*c* is a 1st embodiment side view of the folder/stand in a fully erected position.
Figure 3:
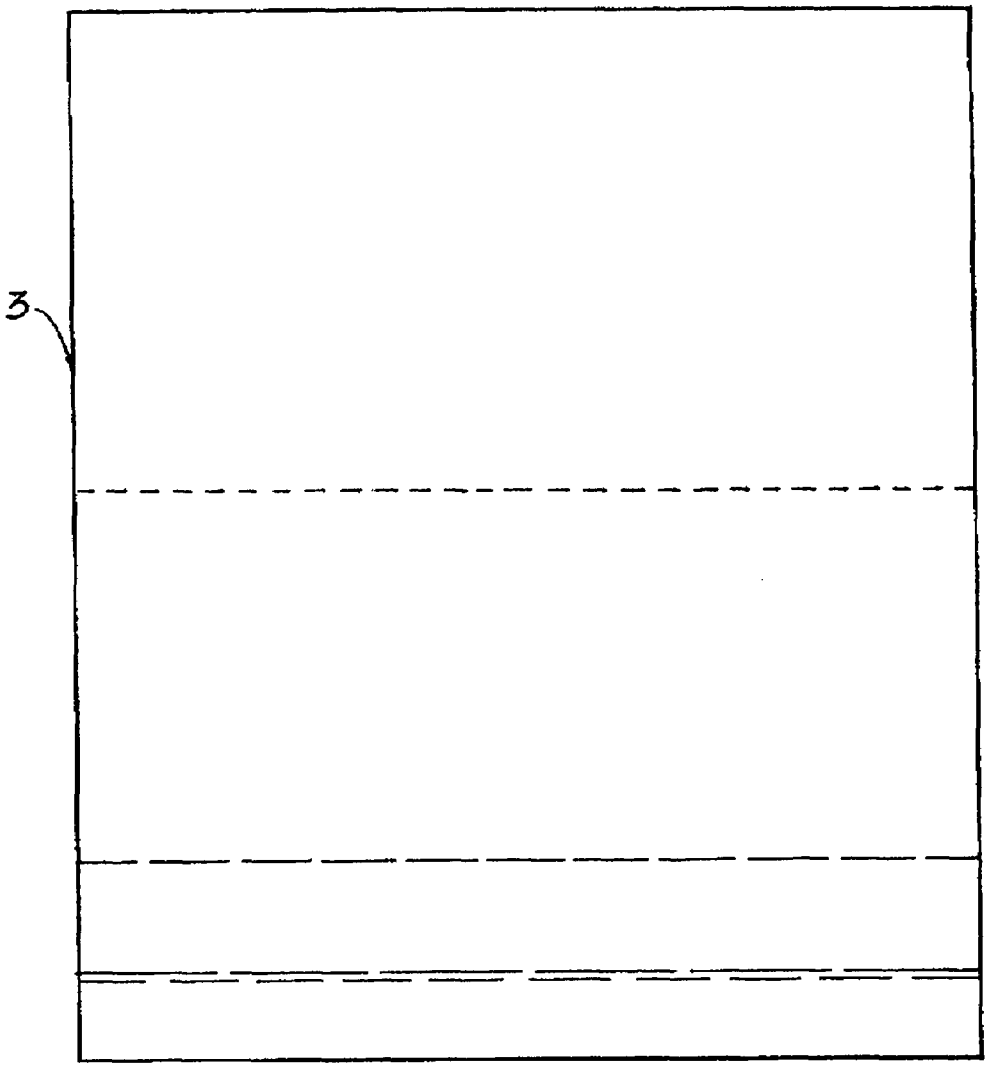
FIG. 3 is a 1st embodiment view of the front cover in a closed position.
Figure 7:
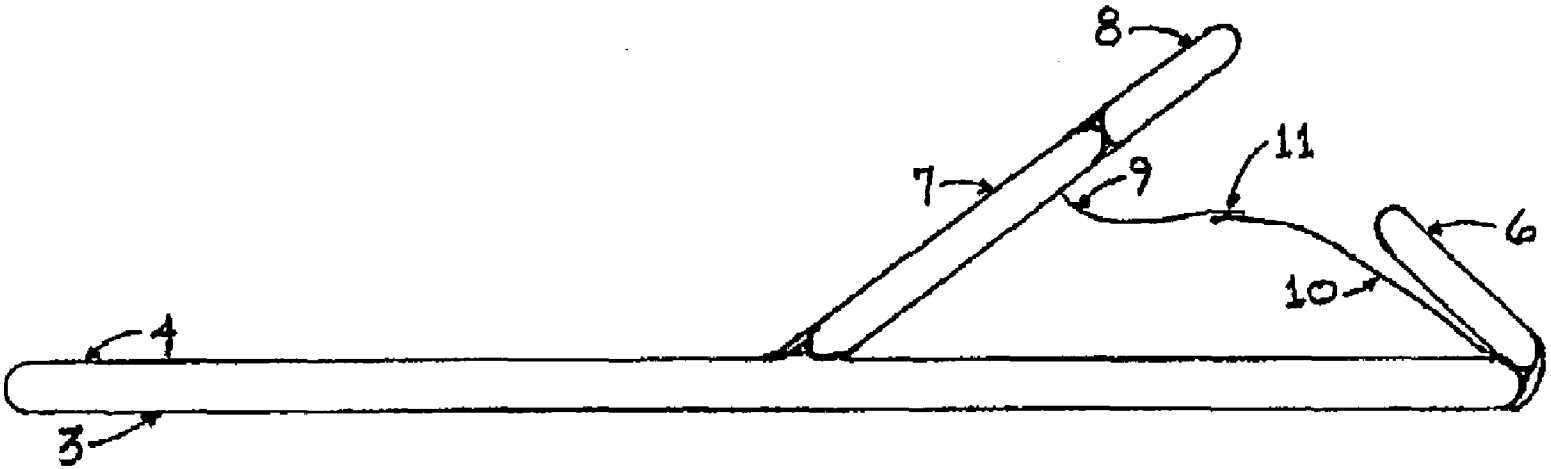
FIG. 7 is a 2nd embodiment view of a side edge of the folder/stand with the supports partially erected.

As seen in the fully erected side view of FIG. 2*c* and the partially erected flaps of FIG. 7, slope of the support surface is maintained via a fastener 11 between the lower flap 8 and the rear of the support lip 6. It is contemplated that fastener 11 can be made of first and second attachments means 9, 10, which are of the hook and loop type fasteners shown in FIGS. 2*c* and 7, with relative movement between the two permitting for varying inclinations of flat surfaces 1, 2, in effect adjusting the slope of the book stand. Also, as seen in FIG. 2*c*, material can be adhered to the upward side of the support lip 6 to help prevent book or documents from sliding off of the support lip 6. While in the closed position, as seen in FIG. 3, both the lower rear panel 7 and the lower flap 8 are collapsed inward for easy storage and/or transportation.

Second Embodiment

Figure 4:
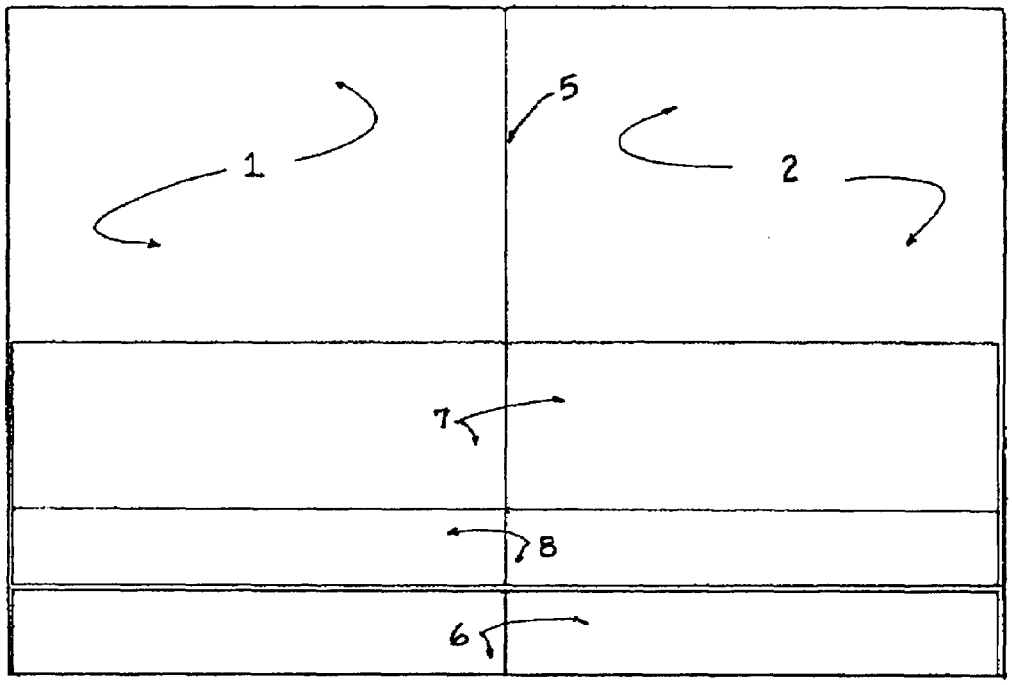
FIG. 4 is a 2nd embodiment view of the inside cover in a fully open position.
Figure 5:
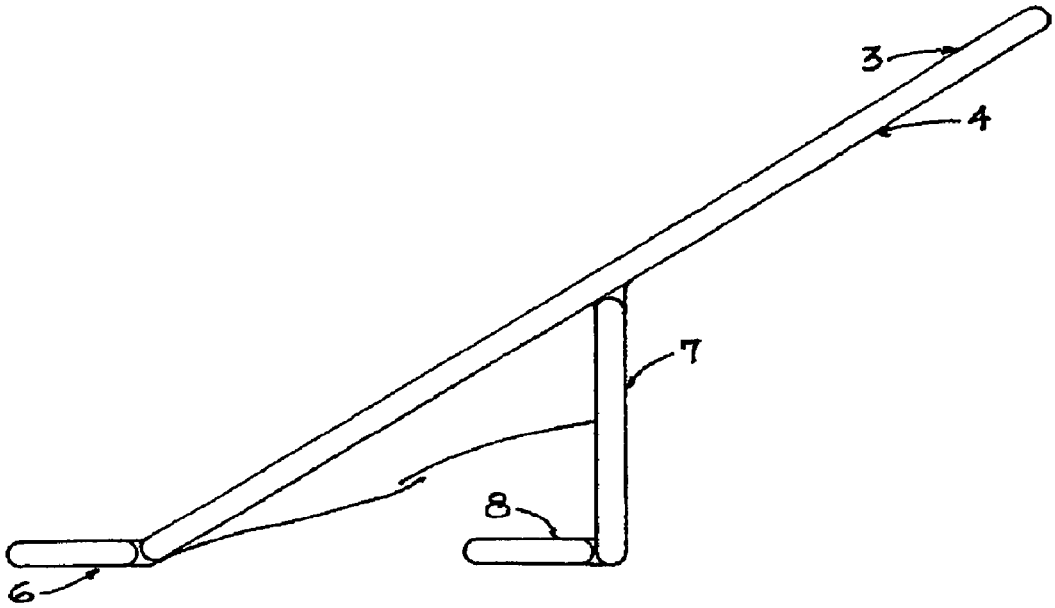
FIG. 5 is a 2nd embodiment side view of the folder/stand in a fully erected position.
Figure 6:
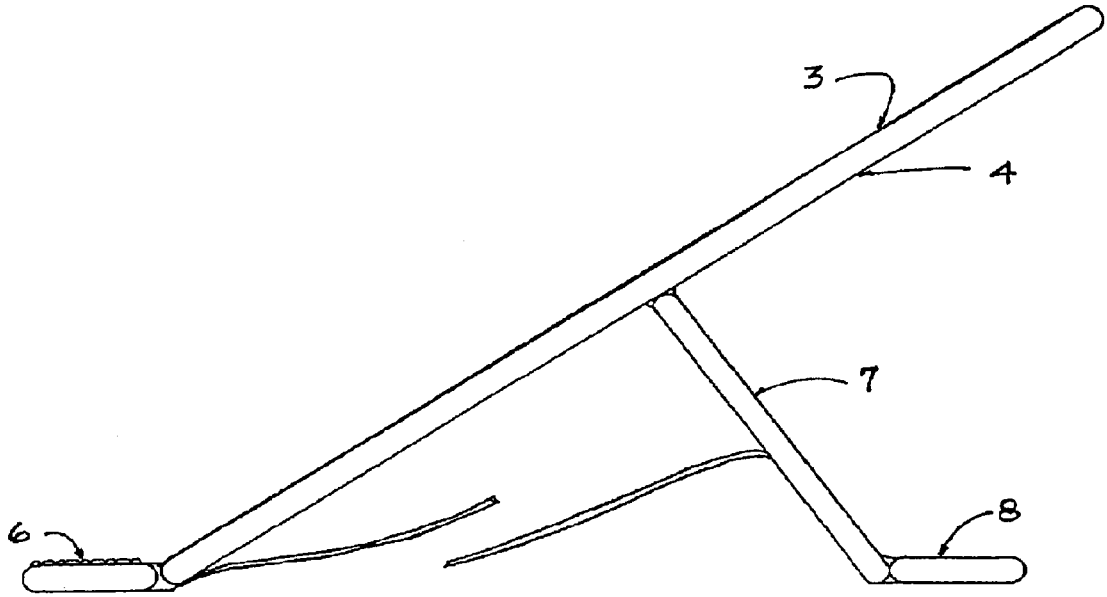
FIG. 6 is a 2nd embodiment side view of the folder/stand in a fully erected position.
Figure 8:
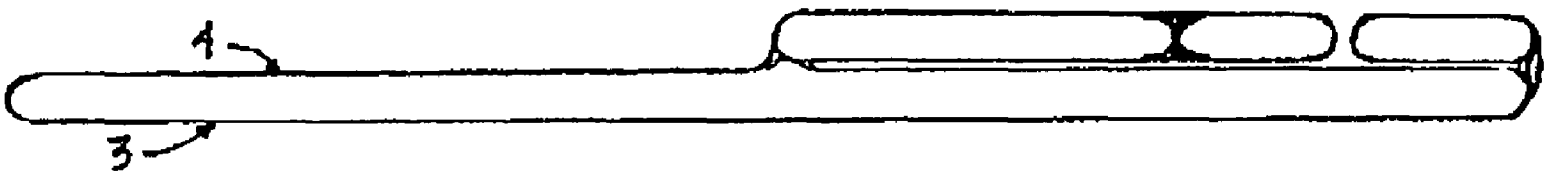
FIG. 8 is a 2nd embodiment view of a side edge of the folder/stand with the cover open.
Figure 9A:
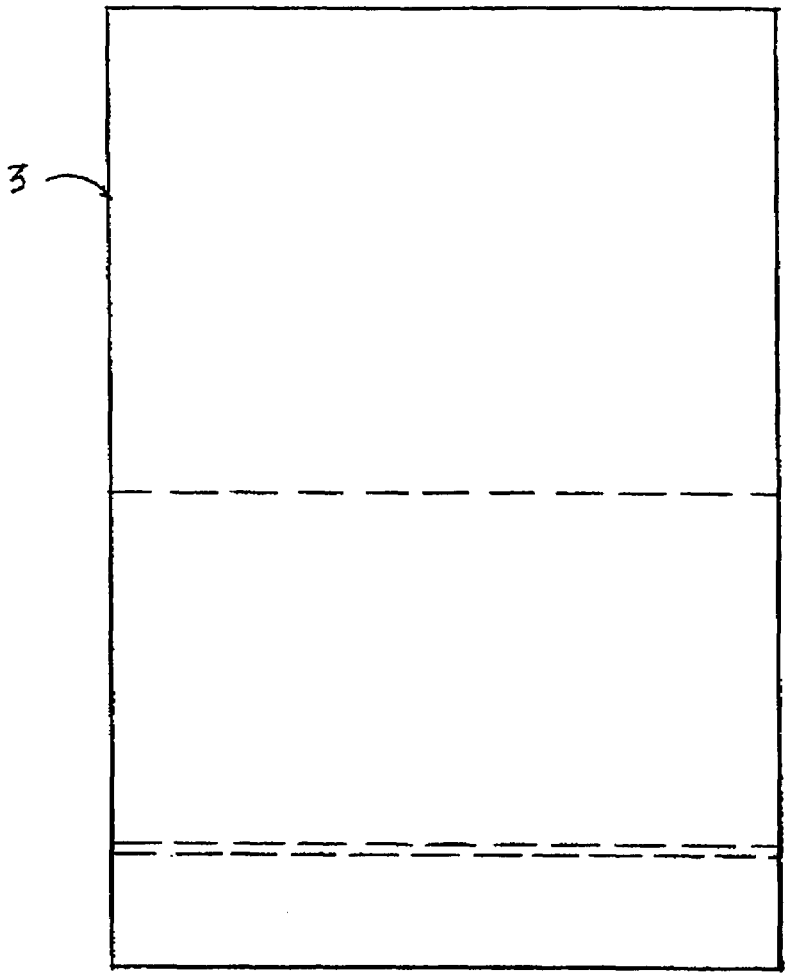
FIG. 9*a* is a 2nd embodiment view of the front cover in a closed position.
Figure 9B:
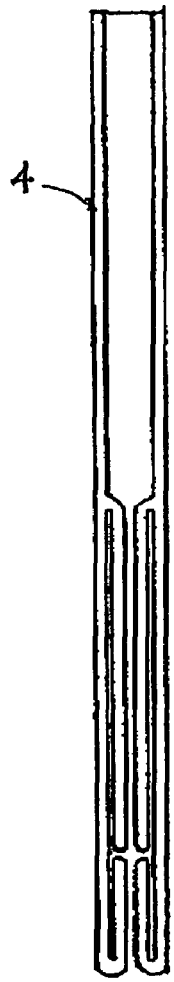
FIG. 9*b* is a 2nd embodiment view of a side edge of the folder/stand in a closed position.
Figure 9C:
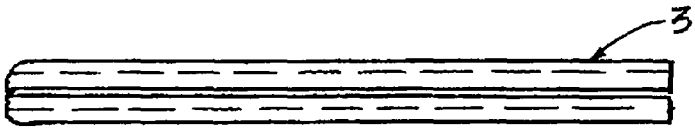
FIG. 9*c* is a 2nd embodiment view of a bottom edge of the folder/stand in a closed position.

FIG. 4 is a frontal unfolded view displaying members in an unfolded ready for setup or ready for storage position. The book stand consists of two sides 1, 2, which are formed by scoring a sturdy cardboard like substance into halves or affixing two sections into one by using a flexible fastener 5 for the left side 1 and right side 2 to fold together. The flat surface areas can be embroidered with various decors. The support lip/flap 6 is attached to the lower edge of the book stand 4 as shown in FIG. 5. Material can be adhered to the upward side of the support lip 6 to help prevent book or documents from sliding off of the support lip 6. The lower rear panel 7 can be scored or affixed to rear face support surface 3 at relatively any horizontal location. The lower flap 8 is affixed to the lower rear panel 7. When in the opened or unfolded position as seen in FIG. 5, the lower flap 8 can be folded upward and fastened to the lower rear panel 7. The fastener 11 between the lower rear flap 8 and the lower edge of the rear face support surface 3, as shown in FIG. 5, is used to adjust the slope of the book stand 12. FIGS. 6-8 show a side view of the 2nd embodiment with the flaps/lips 6, 8, folded between fully erected, partially erected, and cover open/unfolded positions. When the book stand is in the closed position of FIGS. 9*a*-9*c*; the support lip 6, the lower rear panel 7, and the lower flap 8 are collapsed and fold inward for easy storage and/or transportation.

The above embodiments of the instant invention have been presented so as to not limit the invention to only those embodiments. It is contemplated that obvious variations, modifications, and improvements are within the skill of one familiar to relevant arts.

What is claimed is:

1. A book stand comprising:

a main right portion; a main left portion; the right and left portions each having an outer and inner face; the right portion and left portion pivotally attached to each other along longitudinal edges thereof; the right and left portions each having respective lower support sections pivotally attached to and longitudinally extending along an entire length of bottom edges thereof; the inner faces having respective right and left rear support sections pivotally attached thereto; the right and left rear support sections each having respective lower portions pivotally attached to and longitudinally extending along an entire length of bottom edges thereof; a first attachment means affixed to one of the rear support sections; a second attachment means affixed to the inner face of one of the right and left portions; the first and second attachment means adjustably attachable to one another for adjusting the slope of the bookstand; wherein when the book stand is in a closed position, the respective lower support sections and the respective lower portions are aligned in the same plane.

* * * * *